US005930896A

United States Patent [19]

Akiyoshi et al.

[11] Patent Number: 5,930,896

[45] Date of Patent: Aug. 3, 1999

[54] APPARATUS AND METHOD FOR FORMING A GEAR

[75] Inventors: Hideyasu Akiyoshi, Kameoka; Shigeo Murata, Kobe; Fumitaka Nishimura, Yokohama, all of Japan

[73] Assignee: Nissan Motor Co., Ltd., Yokehama, Japan

[21] Appl. No.: 08/818,610

[22] Filed: Mar. 14, 1997

[30] Foreign Application Priority Data

Mar. 15, 1996 [JP] Japan ..... 8-058943

[51] Int. Cl.[6] ..... B21D 53/28

[52] U.S. Cl. ..... 29/893.32; 72/108

[58] Field of Search ..... 29/83.32; 72/108, 72/71, 107

[56] References Cited

U.S. PATENT DOCUMENTS

| | | | |
|---|---|---|---|
| 3,675,454 | 7/1972 | Pratt | 72/108 |
| 3,729,967 | 5/1973 | Bauknecht et al. | 29/893.32 |
| 3,894,418 | 7/1975 | Horl | 29/893.32 |
| 5,152,061 | 10/1992 | Himmeroeder | 29/893.32 |
| 5,203,223 | 4/1993 | Himmeroeder | 74/449 |
| 5,237,744 | 8/1993 | Himmeroeder | 29/893.32 |
| 5,404,640 | 4/1995 | Himmeroeder | 29/893.32 |

FOREIGN PATENT DOCUMENTS 5-38667 6/1993 Japan .

*Primary Examiner*—P. W. Echols
*Attorney, Agent, or Firm*—Foley & Lardner

[57] ABSTRACT

A rolling process for producing a spur gear. The process comprises the following steps: (a) bringing gear teeth of a generally wheel-shaped toothed tool into press contact with a peripheral portion of a generally wheel-shaped gear material at which portion gear teeth are to be formed; and (b) bringing gear teeth of a generally wheel-shaped backup roller into press contact with the peripheral portion of the gear material in course of formation of the gear teeth under rolling so that the gear teeth of the backup roller are to be in mesh with the gear teeth formed at the peripheral portion of the gear material under the action of the toothed tool. The backup roller has an inclined section for forming a chamfered portion of each tooth of the spur gear to be produced. The inclined section is located at a position corresponding to the chamfered portion of the spur gear.

14 Claims, 3 Drawing Sheets

APPARATUS AND METHOD FOR FORMING A GEAR

BACKGROUND OF THE INVENTION

1. Field of the Invention

This invention relates to improvements in rolling process and apparatus for producing gears to be used in a power transmitting mechanism and a transmission of automotive vehicles and a variety of industrial machines, and more particularly to the improvements in the rolling process and apparatus by which chamfered portions can be formed at the corner portions of each tooth of the gear simultaneously with production of the gear by rolling.

2. Description of the Prior Art

In the past chamfering of teeth of a gear has not been usually accomplished simultaneously with formation of the gear per se. Specifically, the gear per se is first produced by rolling or cutting using a gear-hobbing machine or a gear-shaping machine. Thereafter, corner portions of each tooth of the gear are chamfered by cutting or grinding. However, such chamfering by machining is complicated in operation and process thereby requiring a relatively long time for production of the gear while increasing production cost, particularly where the number of teeth in the gear is large.

Additionally, it has been proposed that portions for chamfering are formed at the opposite ends of the bottom land of gear teeth of a rolling tool so that chamfering at the opposite ends of each tooth of a gear to be produced is made simultaneously with rolling of the gear per se. This proposal is disclosed, for example, in Japanese Patent Publication No. 5-38667. However, the following difficulties have been encountered in this proposal: The rolling tool is complicated in shape owing to the portions for chamfering, and therefore a low-cost machining process such as wire cutting process cannot be used to produce the rolling tool for the gear. This not only increases production cost of the rolling tool, but also applies a high load to the rolling tool so that the rolling tool becomes heavily damaged to wear or the like. That is why the chamfering and the formation of the gear per se have been accomplished with the same tool. Otherwise, the above Japanese Patent Publication describes facilitating production of the rolling tool by dividing the rolling tool into a gear teeth formation section and a chamfering section. However, it is difficult to make a phase-mating between the gear teeth formation section and the chamfering section without producing burr at the parting portion between the sections.

SUMMARY OF THE INVENTION

It is an object of the present invention to provide improved rolling process and apparatus for a gear, which overcome drawbacks encountered in conventional rolling processes and apparatuses for gears.

Another object of the present invention is to provide improved rolling process and apparatus for a gear, by which chamfered portions at corners of the gear can be formed simultaneously with rolling of the gear per se while lowering the machining cost of a rolling tool and reducing damage of the rolling tool during the rolling.

A further object of the present invention is to provide improved rolling process and apparatus for a gear, in which a device for forming chamfered portions in the gear is not provided in a rolling tool (or toothed tool) for rolling the gear per se and is provided in a backup member disposed separate from the rolling tool.

A first aspect of the present invention resides in a rolling process for a gear, comprising the following steps: (a) bringing a toothed tool into press contact with a portion of a gear material, gear teeth being formed at the portion; and (b) bringing a backup roller into press contact with the portion of the gear material in course of formation of the gear teeth under rolling. The backup roller has gear teeth to be in mesh with the gear teeth to be formed at the portion of the gear material, and an inclined section for forming a chamfered portion of each tooth of the gear to be produced. The inclined section is located at a position corresponding to the chamfered portion of the gear.

A second aspect of the present invention resides in a rolling process for a gear, comprising the following steps: (a) preparing a generally wheel-shaped toothed tool having gear teeth at its peripheral portion; (b) preparing a backup roller including a generally wheel-shaped main body section having gear teeth at its peripheral portion, first and second flange-like sections integrally formed at axially opposite ends of the main body section, each flange-like section extending radially outwardly over the gear teeth of the main body section, the first and second flange-like sections respectively having first and second annular portions that face each other, the first and second annular portions respectively having first and second restraining faces that face each other to determine a face width of a gear to be produced by the rolling process, and first and second inclined sections integrally formed at opposite ends of each gear tooth and integrally connected respectively to the first and second restraining faces, each inclined section having a surface inclined to form a chamfered portion of each gear tooth of the gear to be produced, the inclined sections of adjacent gear teeth being integrally contiguous with each other; (c) preparing a generally wheel-shaped gear material having a peripheral portion at which gear teeth is to be formed, the gear teeth being to be in mesh with the gear teeth in the backup roller; (d) bringing the gear teeth of the toothed tool into press contact with the peripheral portion of the gear material; and (e) bringing the gear teeth of the main body section of the backup roller into press contact with the peripheral portion of the gear material in course of formation of the gear teeth by the rolling process so that the gear teeth in the backup roller are in mesh with the gear teeth of the gear material.

A third aspect of the present invention resides in a rolling process for a gear, comprising the following steps: (a) fixedly mounting a gear material on a work shaft that is driven to rotate, the gear material having a portion at which teeth are to be formed; (b) fixedly mounting a toothed tool on a tool shaft that is driven to rotate; (c) rotatably mounting a backup roller on a roller, the backup roller having gear teeth to be in mesh with the gear teeth of the gear material, and an inclined section for forming a chamfered portion of each tooth of a gear to be produced by the rolling process, the inclined section being located at a position corresponding to the chamfered portion of the gear; (d) causing the work shaft and the tool shaft to rotate in timed relation to each other; (e) bringing the toothed tool into press contact with the portion of the gear material by moving the tool shaft; and (f) bringing the backup roller into press contact with the portion of the gear material by moving the roller shaft.

A fourth aspect of the present invention resides in a rolling apparatus for a gear, which comprises a work shaft driven to rotate, a gear material being fixedly mounted and having a portion at which gear teeth to be formed. A toothed tool is fixedly mounted on a tool shaft that is driven to rotate. A backup roller is fixedly mounted on a roller shaft that is driven to rotate. The backup roller has gear teeth to be in mesh with the gear teeth of the gear material, and an inclined section for forming a chamfered portion of each tooth of a gear to be produced by the rolling process, the inclined section being located at a position corresponding to the chamfered portion of the gear. The work shaft and the tool shaft are driven to rotate in timed relation to each other. The toothed tool is brought into press contact with the portion of the gear material by moving the tool shaft. The backup roller is brought into press contact with the portion of the gear material by moving the roller shaft.

A fifth aspect of the present invention resides in a rolling apparatus for a gear, which comprises a work shaft driven to rotate, a generally wheel-shaped gear material being fixedly mounted on the work shaft and has a peripheral portion at which gear teeth are to be formed. A generally wheel-shaped toothed tool is fixedly mounted on a tool shaft that is driven to rotate. A generally wheel-shaped backup roller is rotatably mounted on a roller shaft. The backup roller includes a generally wheel-shaped main body section having gear teeth at its peripheral portion, first and second flange-like sections integrally formed at axially opposite ends of the main body, each flange-like section extending radially outwardly over the gear teeth of the main body, the first and second flange-like sections respectively having first and second annular portions that face each other, the first and second annular portions respectively having first and second restraining faces that face each other to determine a face width of a gear to be produced by the rolling process, and first and second inclined sections integrally formed at opposite ends of each gear tooth and integrally connected respectively to the first and second restraining faces, each inclined section having a surface inclined to form a chamfered portion of each gear tooth of the gear to be produced, the inclined sections of adjacent gear teeth being integrally contiguous with each other. The gear teeth of the toothed tool are brought into press contact with the peripheral portion of the gear material by moving the tool shaft toward the work shaft. The gear teeth of the main body section of the backup roller is brought into press contact with the peripheral portion of the gear material in course of formation of the gear teeth under rolling so that the gear teeth in the backup roller are in mesh with the gear teeth of the gear material by moving the backup roller toward the work shaft.

With the above gear rolling process and apparatus according to the present invention, during formation of the gear teeth by the toothed tool, the backup roller provided with the inclined section for formation of the chamfered portion is brought into press contact with the gear material in the course of rolling, from the opposite side with respect to the toothed tool. Accordingly, the gear material is rolled or formed into the shape having the gear teeth, in which the metal of the gear material flows along the shape of the backup roller which is in mesh with the gear teeth in the course of formation of the gear so as to be brought into contact with the inclined section of the backup roller. As a result, the chamfered portions are formed at the opposite ends of each gear tooth of the gear. Therefore, it is unnecessary to form the inclined sections for the chamfered portions in the toothed tool (as a rolling tool), which becomes heavily damaged with use, so that the toothed tool is simplified in shape and construction. This makes possible to produce the toothed tool by using a low cost machining process such as wire cutting process, in which the production cost is relatively low even in case that the number of gear teeth of the toothed tool is large.

It is usual to use the toothed tool having the same number of the gear teeth as that of the gear to be produced. However, the backup roller is not required to have the same number of the gear teeth as that of the gear to be produced, and therefore it is sufficient that the backup roller is the same in module, pressure angle and the like as the gear to be produced. As a result, it is possible to commonly use existing rollers as the backup roller, and therefore it is sufficient that a small number of backup rollers are always prepared. Even if a new backup roller is produced, the production cost of it is low because the backup roller requires a small number of teeth. Additionally, formation of the gear teeth in the gear material is accomplished mainly by the toothed tool, so that a high thrust force or pressure is hardly applied to the backup roller during formation of the gear teeth. As a result, the backup roller does not become heavily damaged, thereby prolonging the life of the backup roller.

DETAILED DESCRIPTION OF THE INVENTION

Referring now to FIGS. 1A to 1C, 2A to 2C and 3A to 3C, an embodiment of a rolling process for a gear, according to the present invention is illustrated, in which the gear to be produced is a spur gear.

First, a gear rolling apparatus G for accomplishing the rolling process will be discussed with reference to FIGS. 1A to 1C and FIGS. 2A to 2C.

Figure 1A:
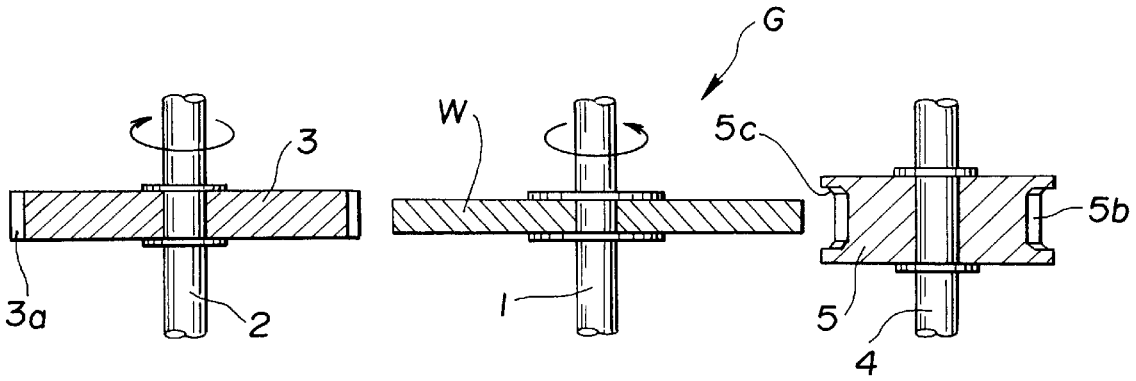
FIGS. 1A to 1C are schematic illustrations showing the steps of a rolling process for a gear, according to an embodiment of the present invention.

In this embodiment, a gear material or workpiece W is generally wheel-shaped and formed with a central hole (not identified). The gear material W is fixedly installed or mounted on a work shaft 1 in such a manner that the work shaft 1 is disposed in the gear material central hole and coaxial with the gear material W as shown in FIG. 1A. A tool shaft 2 is provided parallel with the work shaft 1. A generally disc-shaped toothed tool or roller 3 is fixedly installed or mounted on the tool shaft 2 and has a thickness larger than that of the workpiece W, in which the toothed tool 3 is coaxial with the tool shaft 2. The toothed tool 3 is provided at its peripheral portion with a plurality of gear teeth 3*a*. The toothed tool 3 is parallely movable relative to the work shaft 1 and arranged to be rotatable in timed relation to the work shaft 1. The peripheral teeth 3*a* of the toothed tool 3 are to be in press contact with the peripheral surface of the gear material to thereby form gear teeth at the peripheral portion of the gear material W.

Additionally, a generally wheel-shaped backup roller 5 is rotatably installed or mounted on a roller shaft 4 that is located parallel with the work shaft 1. The backup roller 5 is formed with a central hole (not identified) in which the roller shaft 4 is rotatably disposed to be coaxial with the backup roller 5. The backup roller 5 is located on the opposite side of the gear material W with respect to the toothed tool 3. In other words, the gear material W is located between the backup roller 5 and the toothed tool 3. The backup roller 5 is provided at its peripheral portion with gear teeth 5*b*, which is to be in mesh with the gear teeth formed at the peripheral portion of the gear material W, so that the backup roller 5 is rotated by the gear material W. In this embodiment, the gear teeth 5*b* of this backup roller 5 have the same module and pressure angle as those of the product or gear to be produced. The number of the gear teeth 5*b* of the backup roller 5 is 50, in which the number of the gear teeth 3*a* of the toothed tool 3 is 105, as same as that of a product or gear produced by this gear rolling apparatus G.

Figure 1C:
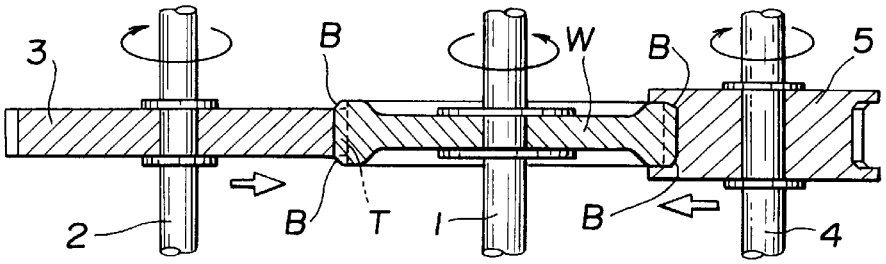
Figure 2A:
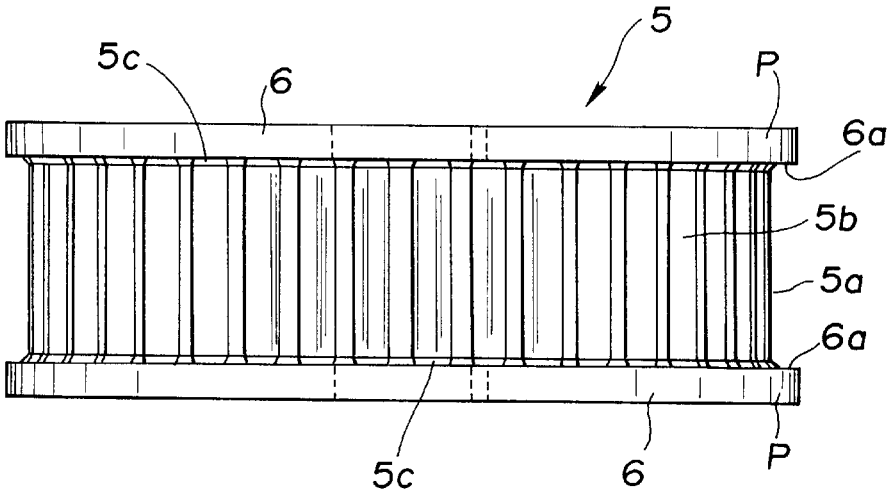
FIG. 2A is a front view of a backup roller used in the rolling process of FIGS. 1A to 1C.
Figure 2B:
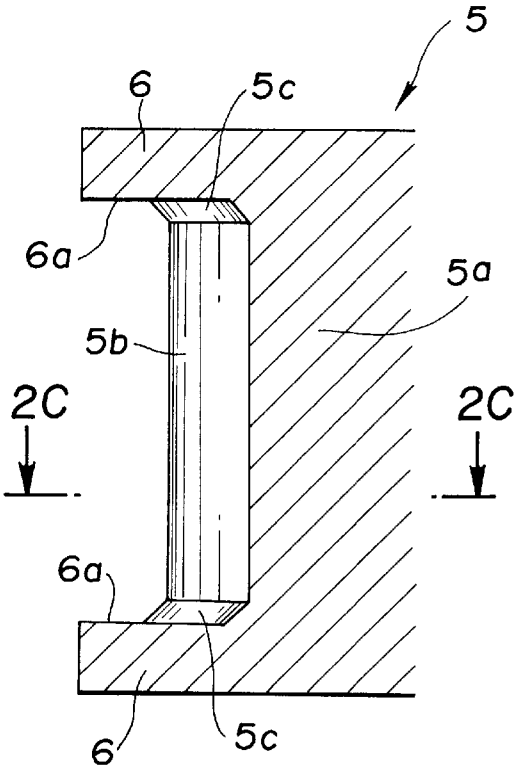
FIG. 2B is an enlarged fragmentary sectional view of the backup roller of FIG. 2A.
Figure 2C:
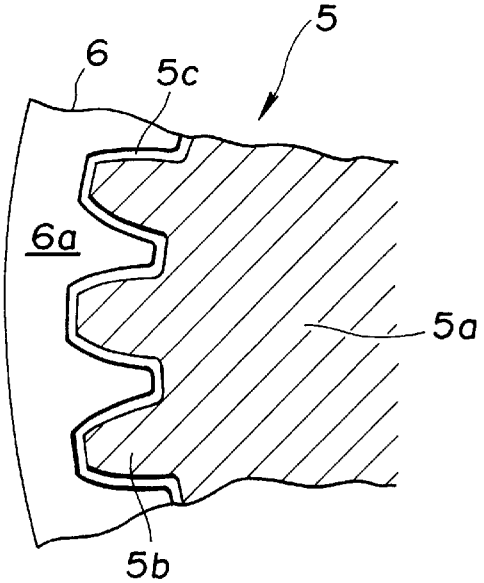
FIG. 2C is an enlarged fragmentary sectional view taken in the direction of arrows substantially along the line 2C—2C of FIG. 2B.

More specifically, as shown in FIGS. 2A to 2C, the backup roller 5 includes a roller main body 5*a* of the spur gear shape or toothed wheel shape. First and second disc-shaped (or flange-like) restraining sections 6 are integrally formed at the axially opposite sides of the roller main body 5*a*. Each restraining section 6 is coaxial with and larger in outer diameter than the roller main body 5*a* so as to have an annular peripheral portion P that radially outwardly extends from the peripheral portion (including the gear teeth 5*b*) of the main body section 5*a*. The annular peripheral portions P of the first and second restraining sections 6, 6 have respectively inner annular restraining faces 6*a*, 6*a* that face each other. These restraining faces 6*a*, 6*a* are arranged to decide the face width (or width of the gear tooth) of the product or gear to be produced by this gear rolling apparatus G. As shown in FIG. 2B, inclined sections 5*c*, 5*c* are respectively formed integrally at the opposite ends of each gear tooth 5*b* of the main body section 5*a*. Each inclined section 5*c* is integrally connected to the restraining face 6*a* of the annular peripheral portion P, and has an inclined face (not identified) that is inclined an angle of about 45 degrees relative to the face of each gear tooth of the main body section 5*a*. Each inclined section 5*c* extends along the outer peripheral profile of the main body section 5*a*, i.e., along the profile of the peripheral face of gear portion (including the bottom lands of gear) of the main body section 5*a* as shown in FIG. 2C. These inclined sections 5*c*, 5*c* formed at the opposite ends of each gear tooth of the main body section 5*a* of the backup roller 5 are arranged to produce chamfered section B (shown in FIG. 1C) at the opposite ends of an edge portion of each gear tooth of the product or gear to be produced by the gear rolling apparatus G.

Figure 1B:
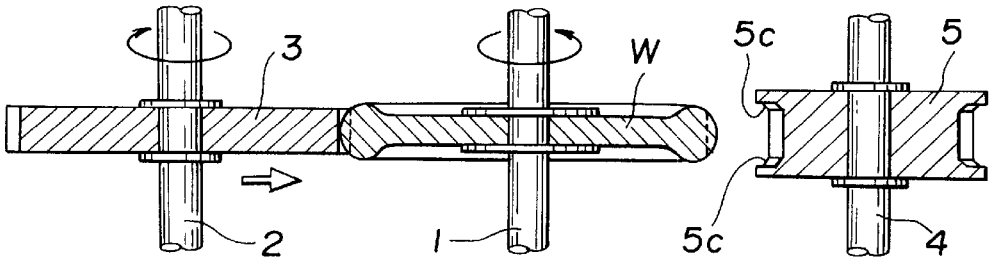

Next, the rolling process of this embodiment will be discussed mainly with reference to FIGS. 1A to 1C.

First, the gear material W, the toothed tool 3 and the backup roller 5 are installed respectively to the work shaft 1, the tool shaft 2, and the roller shaft 4. Then, the work shaft 1 and the tool shaft 2, are driven to rotate in timed relation to each other as shown in FIG. 1A. Then, the tool shaft 2 is moved toward the work shaft 1, so that the toothed tool 3 is brought into press contact with the gear material W as shown in FIG. 1B. At this time, the gear teeth 3*a* formed at the peripheral portion of the toothed tool 3 are brought into press contact with the peripheral portion of the gear material W, thereby forming gear teeth T at the peripheral portion of the gear material W. At this time, each gear tooth T of the gear material W has not been completed and has a tooth height (or the whole depth of the gear) of ⅓ to ½ of that of the product or gear to be rolled by the gear rolling apparatus G.

Thereafter, the roller shaft 4 is moved toward the work shaft 1 by a predetermined distance, and then the toothed tool 3 is further moved in the direction of the gear material W. As a result, the gear material W receives pressing force from both the toothed tool 3 rotating in timed relation thereto and the backup roller 5 rotating upon being in mesh with the incompleted gear teeth T of the gear material W, so that formation of the gear teeth T proceeds to complete the gear teeth T. It is to be noted that the inclined sections 5*c*, 5*c* formed in the backup roller 5 are brought into press contact with the opposite ends of the tip edge portion of each tooth formed at the outer peripheral portion of the gear material W to thereby to form chamfered portions B of each tooth of the gear material W as shown in FIG. 1C.

The process of forming the chamfered portions B will be discussed in detail with reference to FIGS. 3A to 3C which illustrate a metal flow of the gear material W during the rolling process.

Figure 3A:
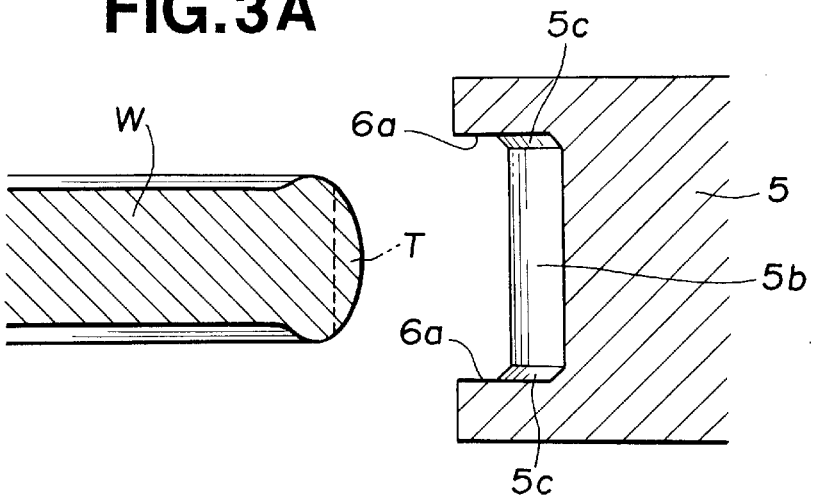
FIGS. 3A to 3C are enlarged fragmentary sectional illustrations showing the steps of formation of gear teeth in a gear material during the rolling process of FIGS. 1A to 1C.
Figure 3B:
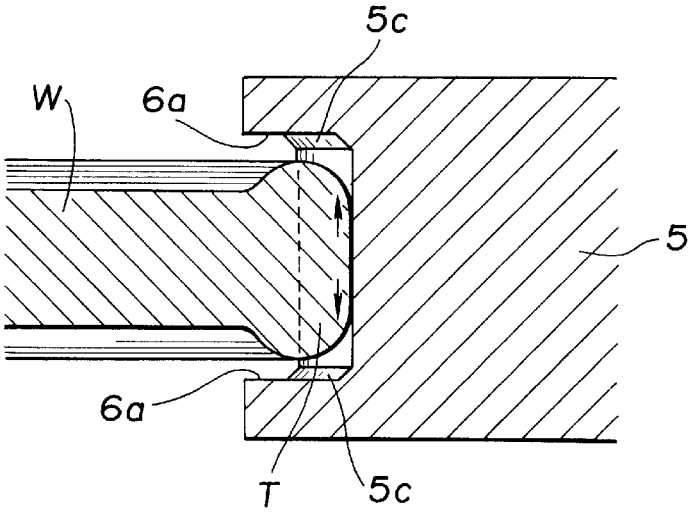

Upon press contact of the toothed tool 3 with the peripheral portion of the gear material W, portions (which will become bottom lands of the gear) of the gear material W are depressed radially inwardly while portions (which will become top lands of the gear) are projected radially outwardly as shown in FIG. 3A. Then, the portions corresponding to the top lands come into press contact with the bottom lands of the gear teeth of the toothed tool 3 and the backup roller 5 so that the peripheral portion of the gear material W extends in the direction of the face width (or width of tooth) of the gear teeth of the backup roller 5 as shown in FIG. 3B. In other words, the metal of the peripheral portion of the gear material W flows in the direction of width of the gear teeth to be formed in the gear material W.

Figure 3C:
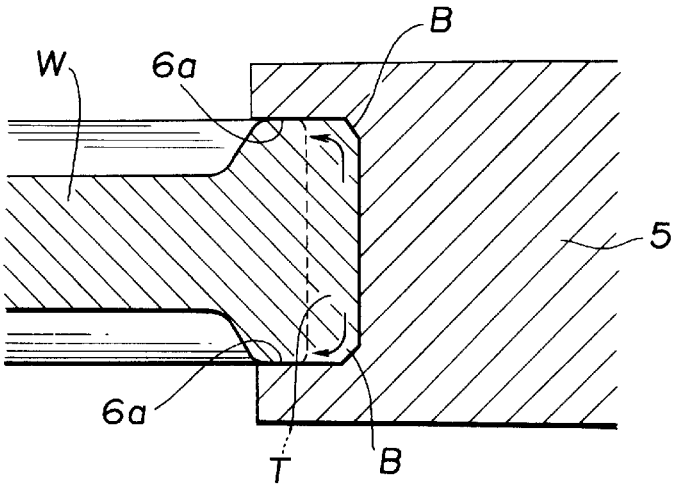

When the metal flowing outwardly in the tooth width direction comes into contact with the inclined sections 5*c*, 5*c* of the backup roller 5, the metal of the gear material W moves along the restraining faces 6*a*, 6*a* of the annular peripheral portions P of the flange-like restraining sections 6, 6 of the backup roller 5 as shown in FIG. 3C, thus forming the chamfered portions B, B at the edge portions of the gear teeth of the gear material W (or the gear to be produced). During the above rolling process, formation of the gear teeth of the gear material W is accomplished mainly by the toothed tool 3. Therefore an excessive pressure cannot be applied to the backup roller 5 having the inclined sections 5*a*, 5*a*, thereby to prolong the life of the backup roller 5.

What is claimed is:

1. A process for producing a gear, comprising:

providing a work gear and enabling the work gear to rotate about a first axis;

providing a toothed tool having gear teeth along an outer circumferential periphery thereof, and enabling the toothed tool to rotate about a second axis;

providing a backup roller having gear teeth along an outer circumferential periphery thereof, and inclined sections along lateral edges of the gear teeth, and enabling the backup roller to rotate about a third axis, the inclined sections being inclined relative to the third axis; and pressingly contacting the toothed-tool gear teeth with an outer-circumferential periphery of the work gear to form gear teeth therearound, while the work gear rotates about the first axis and the toothed tool rotates about the second axis; and pressingly meshing the backup-roller gear teeth against the gear teeth formed on the work gear, while the backup roller rotates about the third axis, until lateral corners of the gear teeth formed on the work gear engage the inclined sections and form circumferentially extending chamfers on each gear tooth formed on the work gear, the circumferentially extending chamfers formed being contiguous with and inclined relative to an outer circumferential periphery of the work gear.

2. A process for producing a gear, comprising:

providing a work gear and enabling the work gear to rotate about a first axis;

providing a generally-wheel shaped toothed tool having gear teeth along an outer circumferential periphery thereof, and enabling the toothed tool to rotate about a second axis;

providing a generally wheel-shaped backup roller having gear teeth along an outer circumferential periphery thereof, first and second opposing flange-like sections extending radially outwardly adjacent the backup-roller gear teeth, the first and second annular portions having first and second opposing restraining faces, respectively, that restrain a face width of the gear teeth to be formed on the work gear, and first and second inclined sections along lateral edges of the back-up roller gear teeth and contiguous with the first and second restraining faces, respectively, and enabling the backup roller to rotate about a third axis, the first and second inclined sections being inclined relative the third axis;

pressingly contacting the toothed-tool gear teeth with an outer-circumferential periphery of the work gear to form gear teeth therearound, while the work gear rotates about the first axis and the toothed tool rotates about the second axis; and pressingly meshing the backup-roller gear teeth against the gear teeth formed on the work gear, while the backup roller rotates about the third axis, until the gear teeth formed on the work gear at least engage the first and second inclined sections and cause the first and second inclined sections to form first and second circumferentially extending chamfers on each gear tooth formed on the work gear, the first and second circumferentially extending chamfers formed being contiguous with and inclined relative to an outer circumferential periphery of the work gear.

3. A process according to claim 2, wherein the work gear is a metal, and the metal flows in direction of width of the gear teeth to be formed until the metal engages the first and second restricting faces.

4. A process according to claim 2, wherein each of the first and second inclined sections extends continuously adjacent the periphery of the backup-roller gear teeth.

5. A process according to claim 2, wherein the backup-roller gear teeth each have a gradually curved profile.

6. A process according to claim 2, further comprising:

fixedly mounting the work gear on a work shaft that is driven to rotate about the first axis;

fixedly mounting the toothed tool on a tool shaft that is also driven to rotate about the second axis;

rotatably mounting the backup roller on a roller shaft about the third axis; and rotating the work shaft and the tool shaft in timed relation with each other.

7. A process according to claim 6, wherein the tooth shaft is moved toward the work shaft to engage the toothed tool to the work gear and the roller shaft is moved toward the work shaft to mesh the gear teeth formed on the work gear with the backup-roller gear teeth.

8. A process according to claim 6, further comprising arranging the work shaft, the tool shaft, and the roller shaft so that the work shaft is located between the tool shaft and the roller shaft, with the first, second, and third axes parallel to each other along a common plane.

9. A process for forming a gear, comprising:

providing a work gear, and fixedly mounting the work gear on a work shaft that is driven to rotate about a first axis;

providing a toothed tool having gear teeth along an outer circumferential periphery thereof, and fixedly mounting the toothed tool on a tool shaft that is driven to rotate about a second axis;

providing a backup roller having gear teeth along an outer circumferential periphery thereof, and inclined sections along lateral edges of the gear teeth, and rotatably mounting the backup roller on a roller shaft, the backup roller being rotatable about a third axis, the inclined sections being inclined relative the third axis;

rotating the work shaft and the tool shaft in timed relation with each other;

moving the tool shaft toward the work shaft to pressingly contact the toothed-tool gear teeth with an outer-circumferential periphery of the work gear to form gear teeth therearound; and moving the roll shaft toward the work shaft to pressingly mesh the backup-roller gear teeth against the gear teeth formed on the work gear, until lateral corners of the gear teeth formed on the work gear engage the inclined sections and form circumferentially extending chamfers on each gear tooth formed on the work gear, the circumferentially extending chamfers formed being contiguous with and inclined relative to an outer circumferential periphery of the work gear.

10. A process according to claim 9 further comprising arranging the work shaft, the tool shaft, and the roller shaft so that the work shaft is located between the tool shaft and the roller shaft, with the first, second, and third axes parallel to each other along a common plane.

11. A gear forming apparatus comprising:

a work shaft rotatable about a first axis, the work shaft being adapted to fixedly mount a work gear;

a tool shaft rotatable about a second axis;

a toothed tool fixedly mounted on the tool shaft, the toothed tool having gear teeth along an outer circumferential periphery thereof;

a roller shaft rotatable about a third axis;

a backup roller rotatably mounted to the roller shaft and rotatable about a third axis, the backup roller having gear teeth along an outer circumferential periphery thereof, and inclined sections along lateral edges of the gear teeth, the inclined sections being inclined relative the third axis, wherein the work shaft and the tool shaft are adapted to be driven to rotate in timed relation with each other, wherein the tool shaft is movable toward the work shaft to pressingly contact the toothed-tool gear teeth with an outer-circumferential periphery of the work gear to form gear teeth therearound, and wherein the roll shaft is movable toward the work shaft to pressingly mesh the backup-roller gear teeth against the gear teeth formed on the work gear, until lateral corners of the gear teeth formed on the work gear engage the inclined sections and form circumferentially extending chamfers on each gear tooth formed on the work gear, the circumferentially extending chamfers formed being contiguous with and inclined relative to an outer circumferential periphery of the work gear.

12. An apparatus according to claim 11, wherein the work shaft is positioned between the tool shaft and the roller shaft, with the first, second, and third axes parallel to each other along a common plane.

13. A gear forming apparatus comprising:

a work shaft rotatable about a first axis, the work shaft being adapted to fixedly mount a work gear;

a tool shaft rotatable about a second axis;

a generally wheel-shaped toothed tool fixedly mounted on the tool shaft, the toothed tool having gear teeth along an outer circumferential periphery thereof;

a roller shaft rotatable about a third axis;

a generally wheel-shaped backup roller rotatably mounted to the roller shaft and rotatable about a third axis, the backup roller having gear teeth along an outer circumferential periphery thereof, first and second opposing flange-like sections extending radially outwardly adjacent the backup-roller gear teeth, the first and second annular portions having first and second opposing restraining faces, respectively, that restrain a face width of the gear teeth to be formed on the work gear, and first and second inclined sections along lateral edges of the back-up roller gear teeth and contiguous with the first and second restraining faces, respectively, and enabling the backup roller to rotate about a third axis, the first and second inclined sections being inclined relative the third axis, wherein the work shaft and the tool shaft are adapted to be driven to rotate in timed relation with each other, wherein the tool shaft is movable toward the work shaft to pressingly contact the toothed-tool gear teeth with an outer-circumferential periphery of the work gear to form gear teeth therearound, and wherein the roll shaft is movable toward the work shaft to pressingly mesh the backup-roller gear teeth against the gear teeth formed on the work gear, until lateral corners of the gear teeth formed on the work gear engage the first and second inclined sections and form first and second circumferentially extending chamfers on each gear tooth formed on the work gear, the first and second circumferentially extending chamfers formed being contiguous with and inclined relative to an outer circumferential periphery of the work gear.

14. An apparatus according to claim 13, wherein the work shaft is positioned between the tool shaft and the roller shaft, with the first, second, and third axes parallel to each other along a common plane.

* * * * *